United States Patent [19]

Marchand

[11] Patent Number: 4,947,497

[45] Date of Patent: Aug. 14, 1990

[54] APPARATUS FOR LIFTING PATIENTS

[76] Inventor: Bernard Marchand, 4 rue Brindejonc des Moulinais, 35400 Saint-Malo, France

[21] Appl. No.: 422,908

[22] Filed: Oct. 18, 1989

[30] Foreign Application Priority Data

Oct. 18, 1988 [FR] France ..... 88 14072
May 3, 1989 [FR] France ..... 89 06162

[51] Int. Cl.[5] ..... A61G 7/14

[52] U.S. Cl. ..... 5/86; 5/81 B; 5/89

[58] Field of Search ..... 5/81 R, 86, 83, 81 B, 5/89

[56] References Cited

U.S. PATENT DOCUMENTS 2,969,730 12/1960 Carnes et al. .
3,394,933 7/1968 Benoit .
3,914,808 10/1975 Woods ..... 5/86

FOREIGN PATENT DOCUMENTS 0119976 3/1984 European Pat. Off. .
2547721 6/1983 France .
9782 of 1914 United Kingdom .
1414644 8/1972 United Kingdom .

*Primary Examiner*—Alexander Grosz

[57] ABSTRACT

Apparatus for lifting patients, in particular for lifting and transporting patients in a sitting position or a lying position, the apparatus being of the type comprising: a generally U-shaped moving base (1) constituted by two substantially horizontal parallel arms (1*a*, 1*b*) and a transverse element (1*c*); an elevator column (2) mounted on the transverse element (1*c*) having a bottom portion (22) fixed to the transfer element, and a top portion or "column head" (20) formed by a telescopic tube moveable in the vertical direction; and support means (S) for supporting the patient; wherein the apparatus includes: a pair of lateral bars (3*a*, 3*b*) extending from each side of the elevator column (2), each of the bars being suitable for receiving a substantially horizontal lifting arm (4*a*, 4*b*) which extends in a direction parallel to the arms (1*a*, 1*b*) in the base, and in the same direction as the arms, the lifting arms (4*a*, 4*b*) carrying the support means (S); and mounting and adjustment means connecting the lateral bars (3*a*, 3*b*) to the elevator column (2), the means serving firstly to fix the arms to the moving column head (20) of the column (2) and secondly to adjust the heights of the positions of the lateral bars (3*a*, 3*b*) relative to the base (1) independently from each other.

12 Claims, 6 Drawing Sheets

APPARATUS FOR LIFTING PATIENTS

The present invention relates to apparatus for lifting patients, and in particular for lifting them and transporting them in a sitting position or a lying position.

BACKGROUND OF THE INVENTION

It is known that hospital personnel encounter problems when moving a patient, e.g. a bedridden invalid, from a bed to a wheelchair. In the absence of any mechanized assistance, it is often necessary to use two people to perform this operation.

Various mechanical aids have already been proposed for enabling a single person to perform this work. In general, such apparatuses operate in a manner similar to that of a forklift truck.

The apparatus described in European patent document EP-A-0 119 976 is a representative example of known mechanical aids. It is constituted by an apparatus including a moving U-shaped chassis, and an elevator column which supports a transverse bar for receiving parallel lifting arms. The transverse bar includes sleeve-shaped means for fixing it to the elevator column and for surrounding the column.

Although the lifting arms are suitable for being displaced vertically in order to transport the person, they cannot be mounted at different heights relative to each other since they are both fixed to the same transverse bar.

Thus, with this type of apparatus, if it is desired to transverse a person sideways while in the sitting position by means of a hammock including supporting straps of different lengths, it is necessary to use a second transverse bar at a different height from the first. Naturally, each transverse bar only receives one lifting arm.

Other apparatuses of this type are described, for example, in the following patent specifications: US-A-2 962 730, FR-A-2 547 721, GB-A-9782/AD 1914, and US-A-3 394 933.

However, as already mentioned, the lifting arms fitted to the apparatuses described in these documents are all at the same height and can only be displaced together, thereby greatly limiting the range of possible applications.

In addition, British patent GB-A-1 414 644 describes an apparatus for giving assistance in climbing stairs, in which foot supports are suitable for being displaced independently from each other. However, this apparatus is unsuitable for moving a person in a lying position or in a sitting position.

The need to modify existing apparatuses in order to increase the number of ways in which they can be used goes against simplifying the work and the speed of action of the person manipulating the apparatus.

Thus, a particular object of the present invention is to remedy these drawbacks by proposing an apparatus which enables patients to be lifted in various positions, without any need to modify the apparatus or to add additional items thereto.

SUMMARY OF THE INVENTION

The present invention provides apparatus for lifting patients, in particular for lifting and transporting patients in a sitting position or a lying position, the apparatus being of the type comprising:

a generally U-shaped moving base constituted by two substantially horizontal parallel arms and a transverse element;

an elevator column mounted on the transverse element having a bottom portion fixed to said transverse element, and a top portion or "column head" formed by a telescopic tube moveable in the vertical direction; and support means for supporting the patient being lifted;

The apparatus includes the improvement whereby:

a pair of lateral bars extending from each side of the elevator column, each of said bars being suitable for receiving a substantially horizontal lifting arm which extends in a direction parallel to the arms in the base, and in the same direction as said arms, said lifting arms carrying said support means; and mounting and adjustment means connecting the lateral bars to the elevator column, said means serving firstly to fix said arms to the moving column head, and secondly to adjust the heights of the positions of said lateral bars relative to the base independently from each other.

Other advantageous, but non-limiting features include:

said mounting and adjusting means are constituted by a series of horizontal oblong holes disposed on opposite sides of the top portion of the elevator column for the purpose of receiving the lateral bars, and by L-shaped retaining hooks having their bases fixed to the top faces of the ends of said lateral bars, with the vertical flange of each hook being suitable for engaging in any one of said oblong holes when the end of said lateral bar is brought to bear against said column head;

said mounting and adjusting means are constituted by series of holes disposed in pairs on opposite sides of the column head and by staple-shaped retaining hooks each having its base fixed to the top face at the end of a corresponding one of said lateral bars, with the upwardly directed flanges of said hooks being suitable for engaging in said holes when the lateral bar is brought to bear against said column head;

said mounting and adjusting means comprise series of studs disposed on the lateral sides of the column head and cooperating with respective keyhole-shaped slots formed in elements fixed to said lateral bars;

the ends of said lateral bars that bear against said column head include respective U-shaped abutments with the base of each abutment being fixed to the corresponding bar and with the flanges of each abutment bearing against opposite front and back sides of said column head;

the inside faces of the flanges of the U-shaped abutments are lined with plastic material;

said lateral bars are slightly inclined in the transverse direction relative to the horizontal;

said mounting and adjusting means enable the lateral bars to be displaced vertically on a continuous basis;

said mounting and adjusting means comprise a pair of vertical slideways disposed on the two lateral faces of the column head, each of which receives a vertically moveable slide with each slide carrying one of the lateral bars;

the apparatus includes a pair of endless screws each suitable for displacing a corresponding one of the slides inside the corresponding slideway;

each lateral bar carries a second bar which runs sustantially parallel thereto and which constitutes an abutment member suitable for supporting the associated lifting arm; and the lateral bar and the lifting arms are circular in section, and each of the lifting arms is mounted on the associated lateral bar by means of a clamping sleeve capable of being displaced both in translation along the lateral bar and in rotation thereabout, and then capable of being locked in the desired position.

BRIEF DESCRIPTION OF THE DRAWINGS

Embodiments of the invention are described by way of example with reference to the accompanying drawings, in which.

DETAILED DESCRIPTION

Figure 1:
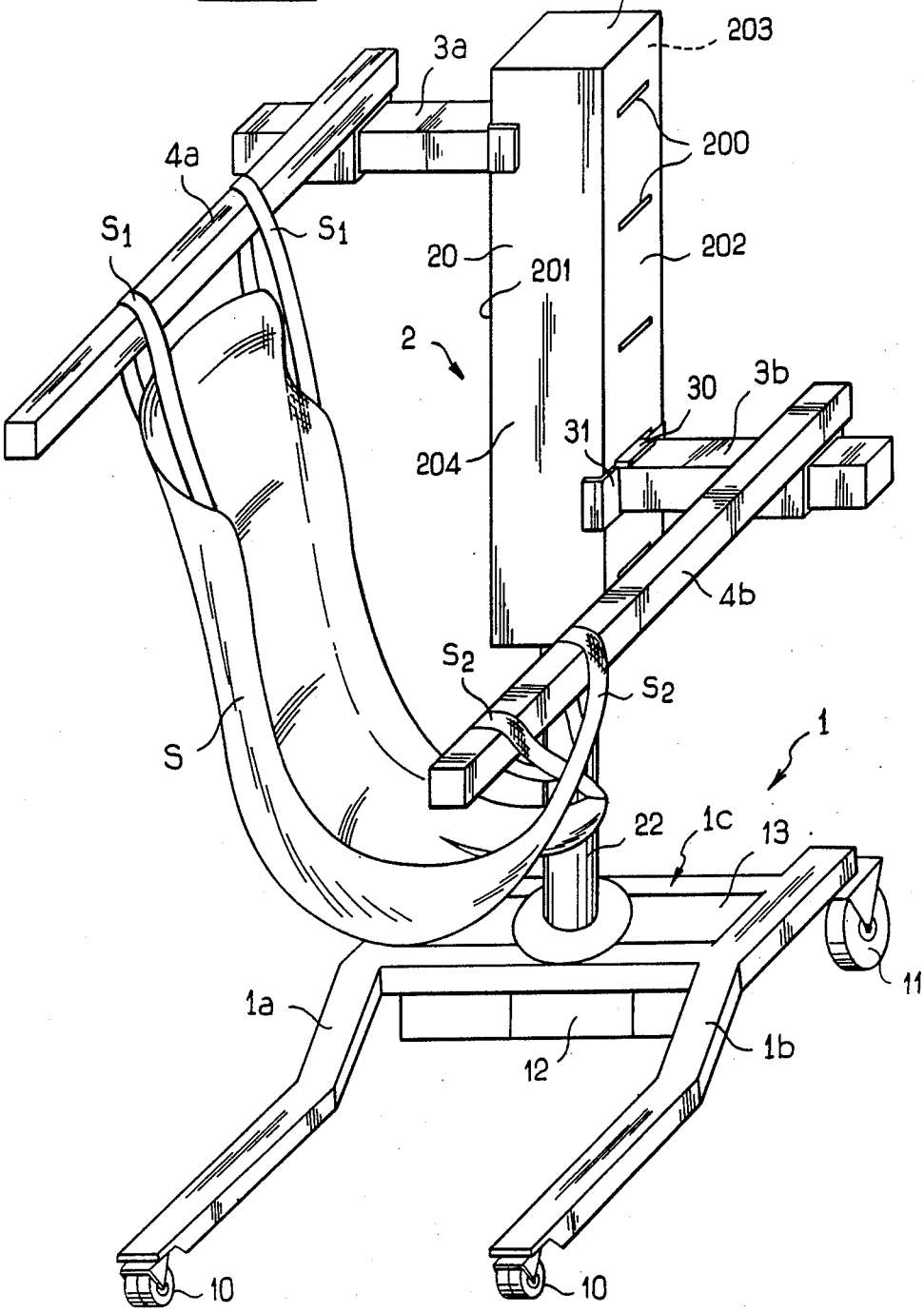
FIG. 1 is a simplified perspective view of a first embodiment of an apparatus in accordance with the invention.

The apparatus shown in FIG. 1 comprises a U-shaped moving base 1. It comprises two arms 1*a* and 1*b* situated in parallel vertical planes, with each arm having horizontal ends and an intermediate sloping portion. The arms are interconnected by a transverse element 1*c*. The arms 1*a* and 1*b* are provided with small front wheels 10 and large rear wheels 11. The transverse element is fitted with a lid 13 giving access to a control box 12 for controlling displacement of an elevator column 2, described below. The central region of the transverse element 1*c* supports the fixed bottom portion 22 and the square section moving top portion 20 of the elevator column 2. The top portion is referred to below as the "column head". This portion is moveable in the vertical direction and is actuated by an actuator (not shown). The side faces 201 and 202 of the column head 20 are provided with respective series of horizontal oblong holes 200. Retaining hooks 30 on the top faces of lateral bars 3*a* and 3*b* are engaged in two of these holes. The lateral bars may be square section metal tubes, for example. Abutments 31 lock the lateral bars against the column head. The lateral bars are fitted with lifting arms 4*a* and 4*b* which extend parallel to the arms 1*a* and 1*b* of the base and in the same direction.

In conventional manner, the arms 4*a* and 4*b* support respective straps $S_1$ and $S_2$ of patient-support means, and in this case of a hammock S for transporting a person in the sitting position.

Figure 3:
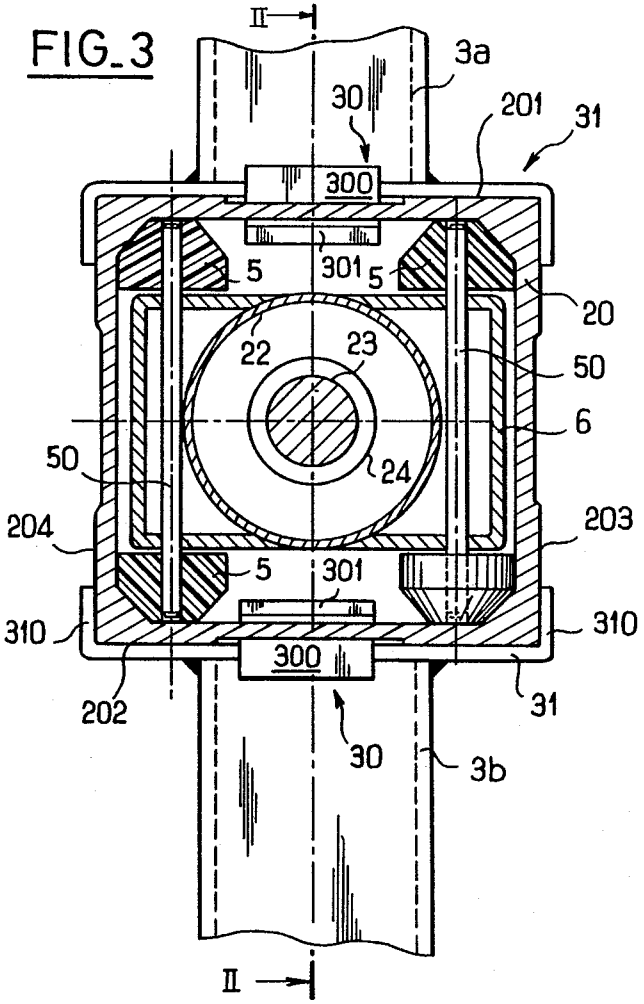
FIG. 3 is a cross-section view through said column on a plane III—III of FIG. 2, and on a slightly larger scale.
Figure 2:
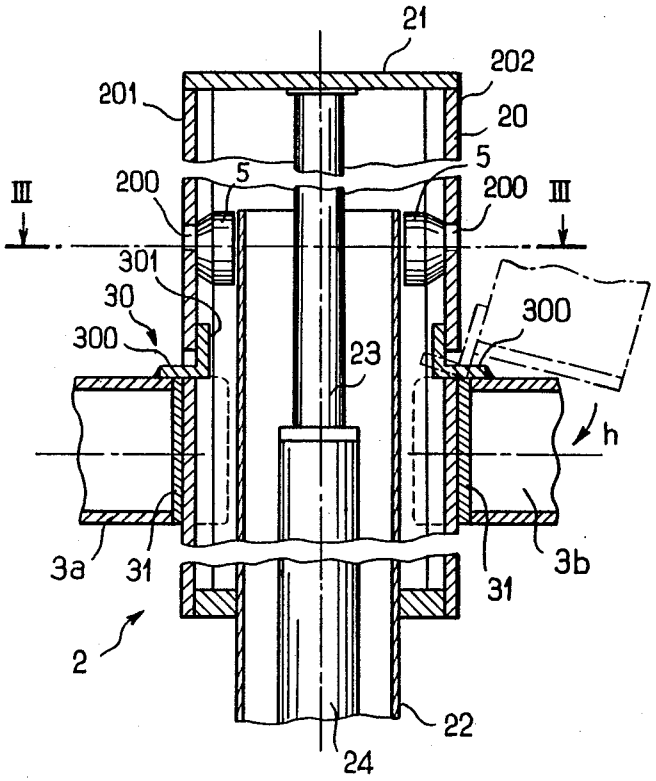
FIG. 2 is a fragmentary longitudinal section through the elevator column of the FIG. 1 apparatus on a plane II—II of FIG. 3.

The elevator column 2 is shown in FIGS. 2 and 3. The fixed bottom portion 22 of the column 2 encloses the body 24 of an actuator, e.g. an electrical actuator, whose rod 23 is fixed to the top end 21 of the moving column head 20 by an appropriate fixing system, e.g. using screws and lock-washers (not shown). It will readily be understood that extending the actuator rod causes the column head 20 to rise. During displacement motion of the column head 20, the head is guided in translation relative to the fixed portion 22 by two pairs of wheels 5 free to rotate about fixed a parallel axes 50 carried by an element 5 of substantially rectangular section and fixed to the bottom portion 22 of the column.

The end of each lateral bar 3*a*, 3*b* is welded to an L-shaped hook 30 and to a U-shaped abutment 31.

The retaining hooks 30 of the lateral bars 3*a* and 3*b* are engaged in two of the holes 200 in respective ones of the faces 201 and 202 of the column head. In FIG. 2, the outline in dot-dashed lines shows the position of the arm 3*b* while the upwardly directly flange 301 of its retaining hook 30 is being inserted in a hole 200. As the arm is moved in the direction of arrow h in FIG. 2, the upwardly directed flange 301 of the hook penetrates into the column head. Simultaneously, the abutment 31 bears against the corresponding face 201 or 202 of the column head and its flanges engage the opposite front and rear faces 203 and 204.

The lateral bar is thus very easily locked to the column head, and it is self-locking, with the weight of the assembly constituted by the lateral bar and its lifting arm increasing the locking effect.

Unlocking and removal are also very easily done, merely by moving in the opposite direction (tilting the bar into a substantially vertical direction).

It will thus be understood that two assemblies 3*a*–4*a* and 3*b*–4*b* are easily fixed in stable manner to the head 20 at various heights which may be the same or different, merely by selecting appropriate holes 200.

Figure 4:
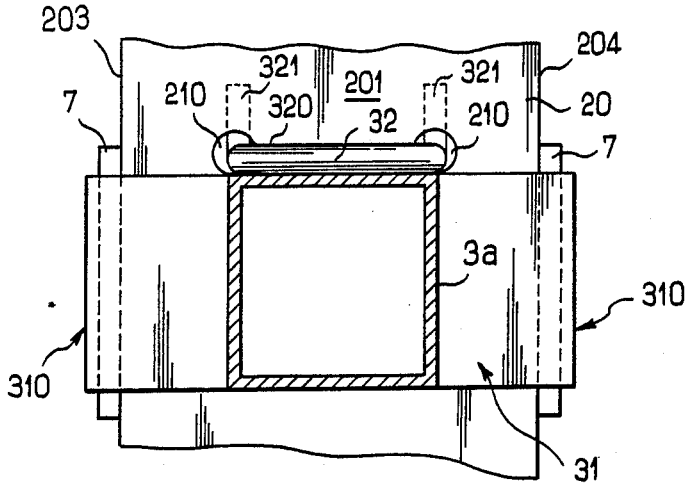
FIG. 4 is a front view of adjustable fixing means for fixing a lateral bar (shown in cross-section) on the elevator column.

FIG. 4 shows a variant of the means for positioning lateral bars on the column head. These positioning means are constituted by a retaining hook 32 made of round metal bar in the form of a U-shape with the ends of its side branches both being turned through a right angle relative to the plane of the U-shape. A hook in this shape is referred to below as a "staple".

Reference 320 designates the transverse branch of the staple and reference 321 designates each of its upturned ends (or flanges).

Like the hooks 30, each staple 32 is welded to one end of an arm 3*a* or 3*b*, along the top face of the arm with the flanges 321 of the staple pointing upwards and extending beyond the end of the associated arm.

Instead of being provided with two series of oblong holes, the column head 2 is provided with two series of pairs of holes 210 (with each pair being situated at the same level), suitable for receiving the flanges 321 of a staple in order to retain the associated bar 3*a* or 3*b* at the desired height.

The inside face of each of the flanges 310 on the abutment 31 is provided with a plate of plastic material 7. This plate is intended to reduce friction between the abutment and the column head, e.g. when they are respectively made of steel and of aluminum.

Figure 5:
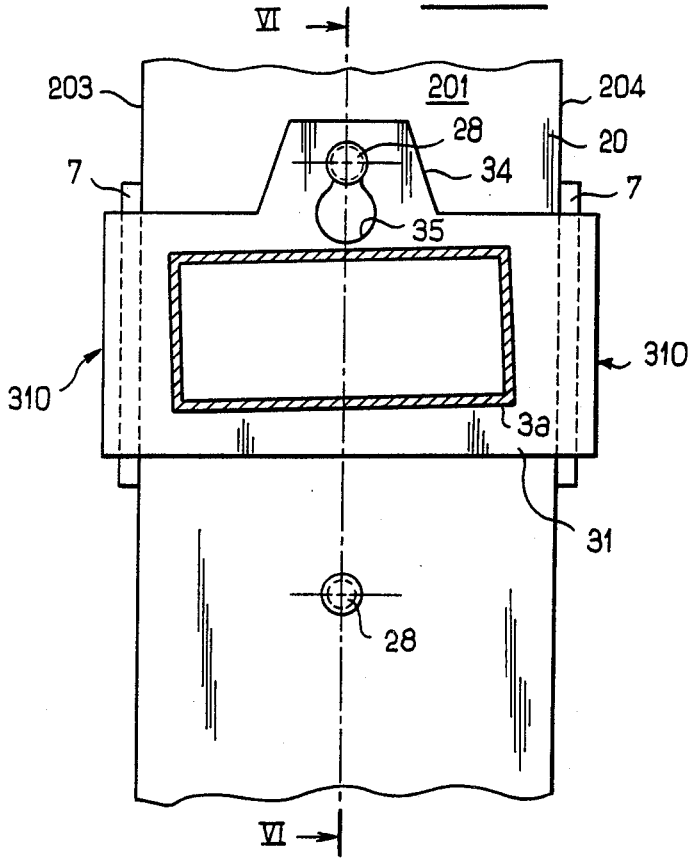
FIG. 5 is a front view of different adjustable fixing means for fixing a lateral bar on the elevator column.
Figure 6:
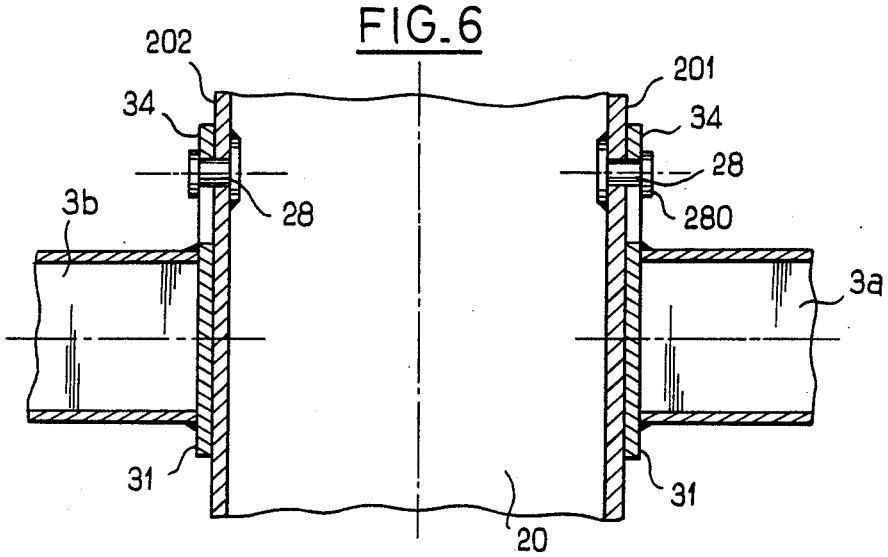
FIG. 6 is a fragmentary view of these positioning means in section on plane VI—VI of FIG. 5.

In the variant shown in FIGS. 5 and 6, a series of studs 28 having enlarged heads 280 is fixed to each of the lateral faces 201 and 202 of the column head 20. These studs are regularly spaced apart vertically along the entire length of the head 20 and they run along the middle of each face 201 or 202. Each abutment 31 carried by the lateral bars 3a or 3b is provided with a keyhole-shaped opening 35 in the middle of its top portion 34 and suitable for being engaged over and retained on the selected stud in the manner which is well known per se. As in the preceding embodiment, the abutment 31 is U-shaped with flanges 31 clamping against the front and rear faces 203 and 204 of the column head via respective bearing pads 7.

Figure 7:
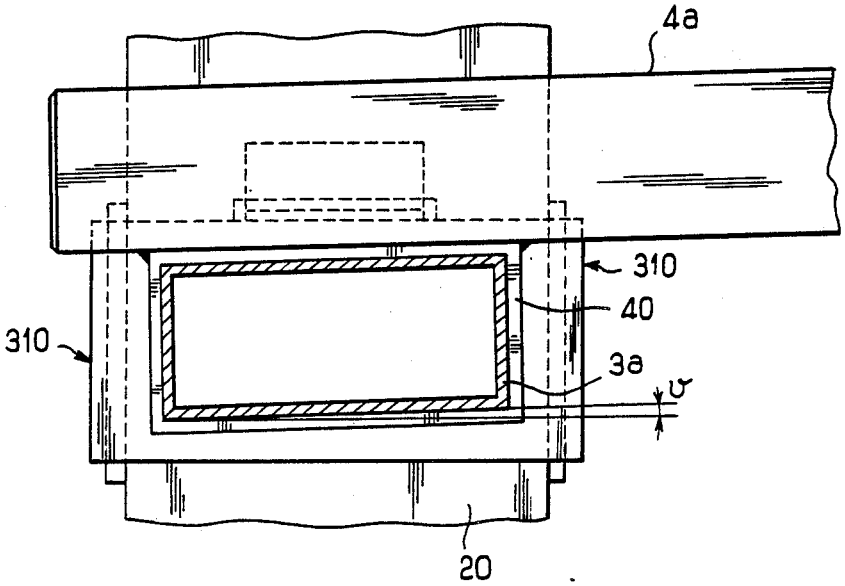
FIG. 7 is a front view of means for positioning the lifting arms on the lateral bars.

The view of FIG. 7 is intended to show how the lifting arms are placed on the lateral bars. Thus, the bottom face of the arm 4a is provided with a sleeve 40 (e.g. welded thereon) which is complementary in shape to the cross-sectional shape of the bar 3a, plus a little clearance. It can be seen in the figure that the bar 3a is slightly inclined through an angle v relative to the horizontal. If the bar were horizontal, then the arm 4a would tend to droop slightly by virtue of its weight and the clearance that exists between the sleeve 40 and the lateral bar 3a. Thus, the arm 4a is slightly raised towards its strap carrying end (to the right in FIG. 7) such that when the hammock straps or the person-transporting harness are placed thereon, the risk of them sliding and falling off the arm in untimely manner is reduced.

The apparatus described above thus makes it possible to transport a patient in various different positions as a function of the selected disposition of the lateral bars (same height or different heights).

The other accompanying figures relate to a second embodiment of the apparatus of the invention. Portions of this variant which are identical to portions of the first example described above are not shown again. This applies in particular to the base of the apparatus.

Figure 8:
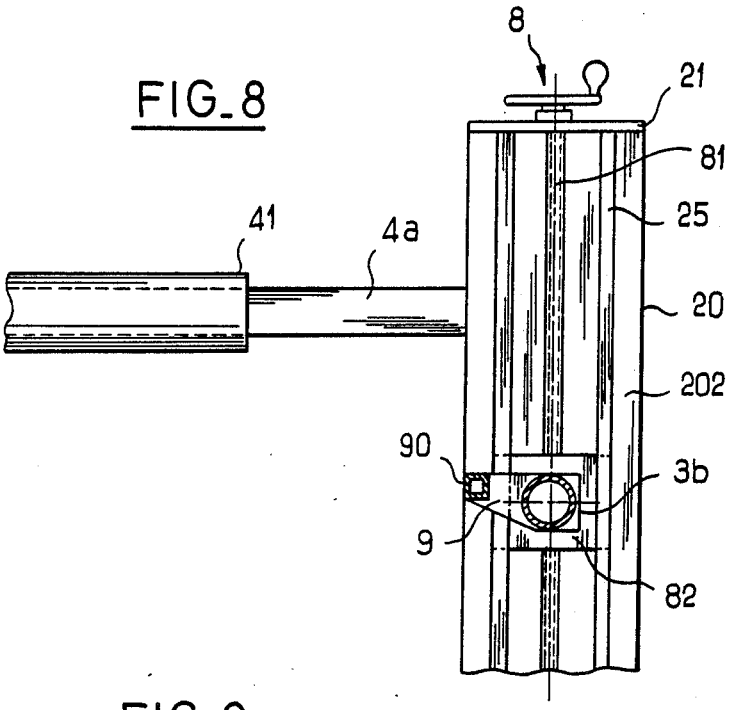
FIG. 8 is a fragmentary front view of a second embodiment of the apparatus, in partial section on plane VIII—VIII of FIG. 9.
Figure 9:
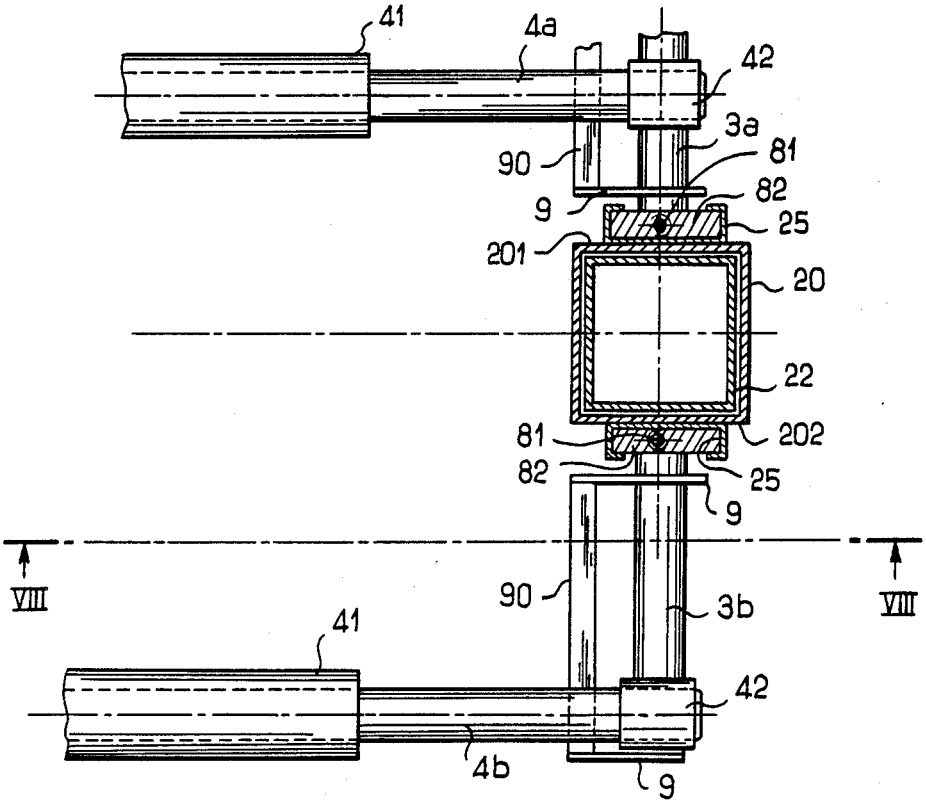
FIG. 9 is a plan view in cross-section of said embodiment.

With reference to FIGS. 8 and 9, it can be seen that the elevator column head 20 and the bottom fixed portion 22 have nesting square cross-sections. The column head is raised and lowered under the control of a motor and stepdown gear unit driving and endless screw (not shown). Alternatively a hydraulic or an electrical actuator could be used.

The faces 201 and 202 of the column head are fitted with respective C-shaped vertical slideways 25 whose webs are fixed to the corresponding faces and whose flanges project outwards. An endless screw 81 runs along the long axis in the middle of each slideway.

The top and bottom ends of each endless screw are connected to the head 20 so as to be free to rotate while being prevented from moving in translation relative thereto. The top end of each screw is fixed to a control wheel 8 for rotating the screw.

A slider 82 is provided in each slideway 25 for being guided in translation, with the slider having a tapped hole receiving the screw 81. Rotating the screw in one direction or the other therefore moves the slider up or down the slideway.

The lateral bars 3a and 3b are circular section metal tubes each fixed at one of its ends to a corresponding slider 82. Each of the bars can thus be raised or lowered continuously and independently of the other.

The lifting arms 4a and 4b are likewise constituted by circular section tubes. Each of them carries a plastic sleeve 41 against which the straps (not shown) of a hammock or basket are intended to bear.

Figure 10:
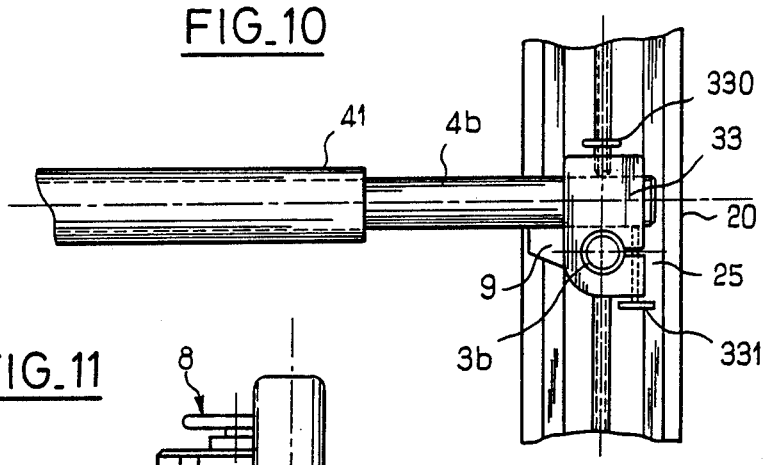
FIG. 10 shows how the lifting arms are adjusted on the lateral bars of the apparatus.

The lifting arms are longitudinally adjustable (relative to their own axes) in respective sleeves 33 (FIG. 10) within which they can be locked at a desired extension position by means of respective pressure screws 330. Each of the sleeves 33 is itself adjustable in axial position along the corresponding lateral bar 3a or 3b. To this end, the sleeves 33 are in the form of a split collars capable of being clamped to the associated bar 3a or 3b by means of a clamping screw 331.

The forces applied to each of the lifting arms (forces due in particular to the weight of the person being transported) are absorbed to a large extent by a thrust bar 90 constituting a downwards abutment for the associated lifting arm. Each bar 90 is disposed parallel to one of the bars 3a and 3b and its ends are fixed to mounting plates 9 which are fixed in turn to the corresponding bar 3a or 3b.

Figure 11:
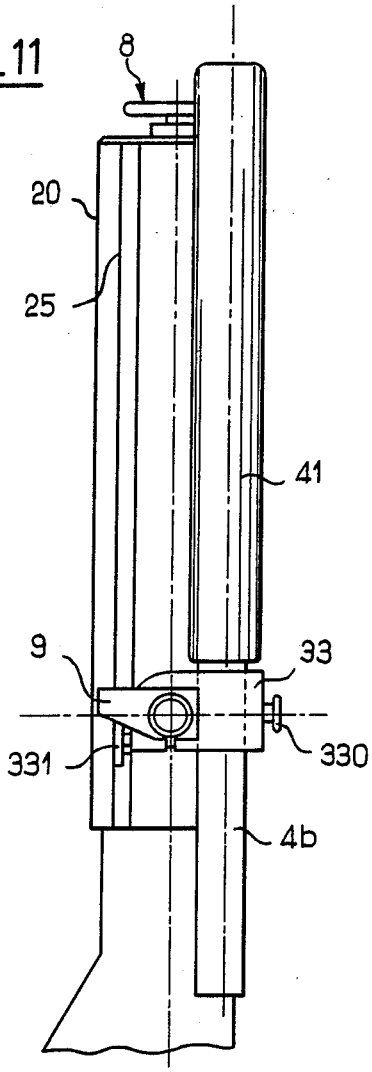
FIG. 11 shows how the lifting arms of the apparatus are stored.

As shown in FIG. 11, when the apparatus is not in use, it is easy to raise the arms 4a and 4b after loosening the screws 331 and rotating the sleeves 33 upwards through ¼th of a turn. The apparatus can thus be stored in a compact configuration.

When the apparatus of this embodiment is used for directly transferring a patient from a position lying on the back to a position sitting in a chair, the apparatus can be used for continuously displacing one of the lifting arms in a vertical direction towards a high position.

Similarly, the other lifting arm may be continuously displaced vertically downwards towards the low position. This disposition makes it possible to fix two back straps of a hammock over the higher lifting arm to constitute retaining means for the patient while lifting and transporting the patient. The other two straps of the basket are preferably crossed, passing between the patient's thighs and are fixed to the lower lifting arm.

The lifting arms have been described as being raised and lowered by means of an endless screw system for obtaining continuous vertical displacement. Other systems could also be used, e.g. a rack system.

As for the design of the lateral bars and the lifting arms, they may be hollow or solid members according to choice.

I claim:

1. Apparatus for lifting patients, in particular for lifting and transporting patients in a sitting position or a lying position, the apparatus being of the type comprising:

a generally U-shaped moving base constituted by two substantially horizontal parallel arms and a transverse element;

an elevator column mounted on the transverse element having a bottom portion fixed to said transverse element, and a top portion or "column head" formed by a telescopic tube moveable in the vertical direction; and support means for supporting the patient;

wherein the apparatus includes:

a pair of lateral bars, one bar extending from each side of the elevator column, each of said bars receiving a substantially horizontal lifting arm which extends in a direction parallel to the arms in the base, and in the same direction as said arms, said lifting arms carrying said support means; and mounting and adjustment means connecting the lateral bars to the elevator column, said means serving firstly to fix said arms to the moving column head of the column and secondly to adjust the heights of the positions of said lateral bars relative to the base independently from each other.

2. Apparatus according to claim 1, wherein said mounting and adjusting means are constituted by a series of horizontal oblong holes disposed on opposite sides of the top portion of the elevator column for the purpose of receiving the lateral bars, and by L-shaped retaining hooks having their bases fixed to the top faces of the ends of said lateral bars, with the vertical flange of each hook being suitable for engaging in any one of said oblong holes when the end of said lateral bar is brought to bear against said column head.

3. Apparatus according to claim 1, wherein said mounting and adjusting means are constituted by series of holes disposed in pairs on opposite sides of the column head and by staple-shaped retaining hooks each having its base fixed to the top face at the end of a corresponding one of said lateral bars, with the upwardly directed flanges of said hooks being suitable for engaging in said holes when the lateral bar is brought to bear against said column head.

4. Apparatus according to claim 1, wherein mounting and adjusting means comprise series of studs disposed on the lateral sides of the column head and co-operating with respective keyhole-shaped slots formed in elements fixed to said lateral bars.

5. Apparatus according to claim 1, wherein the ends of said lateral bars that bear against said column head include respective U-shaped abutments with the base of each abutment being fixed to the corresponding bar and with the flanges of each abutment bearing against opposite front and back sides of said column head.

6. Apparatus according to claim 5, wherein the inside faces of the flanges of the U-shaped abutments are lined with plastic material.

7. Apparatus according to claim 5, wherein said lateral bars are slightly inclined in the transverse direction relative to the horizontal.

8. Apparatus according to claim 1, wherein said mounting and adjusting means enable the lateral bars to be displaced vertically on a continuous basis.

9. Apparatus according to claim 8, wherein said mounting and adjusting means comprise a pair of vertical slideways disposed on the two lateral faces of the column head, each of which receives a vertically moveable slide with each slide carrying one of the lateral bars.

10. Apparatus according to claim 9, including a pair of endless screws each suitable for displacing a corresponding one of the slides inside the corresponding slideway.

11. Apparatus according to claim 8, wherein each lateral bar carries a second bar which runs substantially parallel thereto and which constitutes an abutment member suitable for supporting the associated lifting arm.

12. Apparatus according to claim 11, wherein the lateral bar and the lifting arms are circular in section, and wherein each of the lifting arms is mounted on the associated lateral bar by means of a clamping sleeve capable of being displaced both in translation along the lateral bar and in rotation thereabout, and then capable of being locked in the desired position.

* * * * *